US007612503B2

(12) United States Patent
Bittmann et al.

(10) Patent No.: US 7,612,503 B2
(45) Date of Patent: Nov. 3, 2009

(54) ELECTRIC LAMP HAVING AN OUTER BULB

(75) Inventors: Thomas Bittmann, Friedberg (DE); Thomas Deutscher, Nennslingen (DE); Jürgen Gräf, Augsburg (DE); Richard Semba, Augsburg (DE); Marcel Vuc, Neuburg (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 23 days.

(21) Appl. No.: 11/282,660

(22) Filed: Nov. 21, 2005

(65) Prior Publication Data

US 2006/0108904 A1 May 25, 2006

(30) Foreign Application Priority Data

Nov. 23, 2004 (DE) ..... 10 2004 056 453

(51) Int. Cl.
*H01J 17/16* (2006.01)
*H01J 61/30* (2006.01)

(52) U.S. Cl. ..... 313/634; 313/25; 313/493; 313/573; 313/623

(58) Field of Classification Search ..... 313/25, 313/493, 573, 605, 623, 634, 317, 318.02, 313/318.03, 318.07
See application file for complete search history.

(56) References Cited

U.S. PATENT DOCUMENTS

| | | | | |
|---|---|---|---|---|
| 6,790,115 | B2 | 9/2004 | Fukai et al. | |
| 2002/0063529 | A1 * | 5/2002 | Fukai et al. | 313/623 |
| 2002/0084755 | A1 * | 7/2002 | Ohshima et al. | 313/623 |
| 2002/0105272 | A1 * | 8/2002 | Takagaki et al. | 313/623 |
| 2003/0062839 | A1 * | 4/2003 | Takagaki et al. | 313/634 |
| 2004/0150344 | A1 * | 8/2004 | Takagaki et al. | 313/634 |

FOREIGN PATENT DOCUMENTS

| | | |
|---|---|---|
| EP | 0 465 083 | 1/1992 |
| EP | 0 588 602 | 3/1994 |
| WO | WO 95/32516 | 11/1995 |

* cited by examiner

*Primary Examiner*—Bumsuk Won

(57) ABSTRACT

The elongate inner bulb (1) defines a longitudinal axis (A) and is sealed at mutually opposing ends by sealing parts (6; 32), an outer bulb being placed, with an adjoining tube piece, over the inner bulb and being fixed to the sealing part by means of an annular beading formed there, the end of the tube piece being radially attached to the beading, the maximum inner diameter of the beading being larger than the outer diameter of the sealing part in the region of the beading.

5 Claims, 4 Drawing Sheets

ELECTRIC LAMP HAVING AN OUTER BULB

TECHNICAL FIELD

The invention relates to an electric lamp having an outer bulb in accordance with the precharacterizing clause of claim 1. Of concern here are, in particular, metal halide lamps, mercury high-pressure discharge lamps, but also halogen incandescent lamps having an outer bulb. The inner bulb of the lamp is sealed at two ends using sealing parts. The outer bulb is fixed to one or both of the sealing parts.

PRIOR ART

EP-A 465 083 and EP-A 588 602 have already disclosed an electric lamp having an outer bulb, this lamp having a burner, which is surrounded by an outer bulb fixed to the sealing part. For a better connection, in this case in particular a radial beading is provided on the sealing part, the end of the outer bulb resting on said radial beading and being fused with the beading there.

On the other hand, it is known, for example, from WO 95/32516 to roll an outer bulb directly onto the sealing part without any beading.

U.S. Pat. No. 6,790,115 has disclosed a generic lamp, in the case of which an extension of the seal of the discharge vessel is "scratched" on one side, with the result that a solid beading is produced, to which the outer bulb is fixed.

One disadvantage of these connection techniques is the fact that the robustness achieved of the connection between the outer bulb and the sealing part in any case leaves something to be desired. Without the beading, a time-consuming tempering process is also needed for this purpose.

SUMMARY OF THE INVENTION

One object of the present invention is to provide a lamp in accordance with the precharacterizing clause of claim 1 which ensures a reliable connection, which can be subjected to a load, between the outer bulb and the sealing part of the inner bulb.

This object is achieved by the characterizing features of claim 1. Particularly advantageous refinements are described in the dependent claims.

The lamp according to the invention has an inner bulb, which is sealed in a vacuum-tight manner, in particular a discharge vessel, which defines a lamp axis and is sealed at mutually opposing ends by sealing parts. The sealing part is a pinch seal or else a fuse seal. The luminous means in the interior of the lamp is a discharge arc between two electrodes or a luminous element. It is electrically conductively connected to the internal power supply lines leading to it. The sealing part is in particular provided with an outwardly protruding extension, which is in the form of a hollow tube. An outer bulb is fixed to the sealing part, in particular to its extension, with the aid of a beading. The outer bulb rests on the outside of the beading such that the outer bulb usually protrudes over the length of the beading. The central part of the beading is convex and therefore forms an apex.

In particular, at least one sealing part is provided with a preferably annular beading, which protrudes radially, transversely with respect to the lamp axis, the outer bulb bearing radially on the outside against the edge of the beading. The beading is hollow and has a convex or convex/concave shape, the point of inflection between the convex and concave shape being at a height Hw of approximately half the height H of the apex, namely Hw=0.3 H to 0.7 H. In this case, the maximum inner diameter of the beading is in particular larger than the outer diameter of the sealing part (in particular its extension part) in the vicinity of the beading. The outer bulb may be a continuous tube piece having a constant diameter, but also a bulb having a central bulge and tube pieces attached thereto at the ends.

One preferred embodiment provides for a tubular extension piece of the sealing part, to which the beading is attached. This makes the provision of a radially symmetrical beading possible, even in the case of a pinch seal which is not radially symmetrical. In the case of a fuse seal, such an extension piece is likewise advantageous. Both the inner bulb and the outer bulb are preferably made from quartz glass or hard glass.

In particular, the beading may be designed to be relatively small, with the result that the outer diameter of the protruding beading is typically 25 to 80% larger than the outer diameter of the sealing part. For example, the outer diameter of the beading is only at least 2 mm, typically from 3 mm to 4 mm, larger than the outer diameter of the sealing part, which for its part is typically 7 mm.

Particularly preferred is a hollow beading, which is 30 to 70% larger than the outer diameter of the sealing part bearing it. A particularly pronounced convex design of the beading is thus created which is particularly well suited for the end of the outer bulb to nestle against it radially, since the contact zone with the outer bulb is very wide. The axial length of the contact zone will be referred to below as KZ.

In the case of the conventional convex/concave design of the beading, as is previously known, the contact zone is only very short.

The attachment of the outer bulb to the convex beading improves the strength of the transition quite considerably, to be precise by up to 50%. In contrast to the previously known radial fusing, the contact zone is more than twice as long, based on the axial length. It is typically from 2 to 4 mm long, while it is less than 2 mm long in the case of known concave/convex beadings.

While known concave/convex beadings tend to have central parts, whose axial length at best makes up one fifth of the axial length, the novel shape in cross section is either essentially only convex or its concave/convex shape is pronounced to such a small extent that the convex central part makes up at least one third of the total axial length. In this case, the boundary point between the concave and the convex section is provided by the point of inflection. The convex central part may even have a planar saddle in its center.

The beading can preferably be produced from the sealing part by initially the corresponding point of the sealing part being heated and then deformed, for example by widening by means of a mechanical finger or by introduction of an excess pressure and blowing brought about thereby. In contrast, the conventional compression is in this case not suitable, since it leads to a shape of the beading in cross section which gives the central part M of the beading an axial length which is too short.

BRIEF DESCRIPTION OF THE DRAWINGS

The invention will be explained in more detail below with reference to a plurality of exemplary embodiments. In the drawing.

PREFERRED EMBODIMENT OF THE INVENTION

Figure 1:
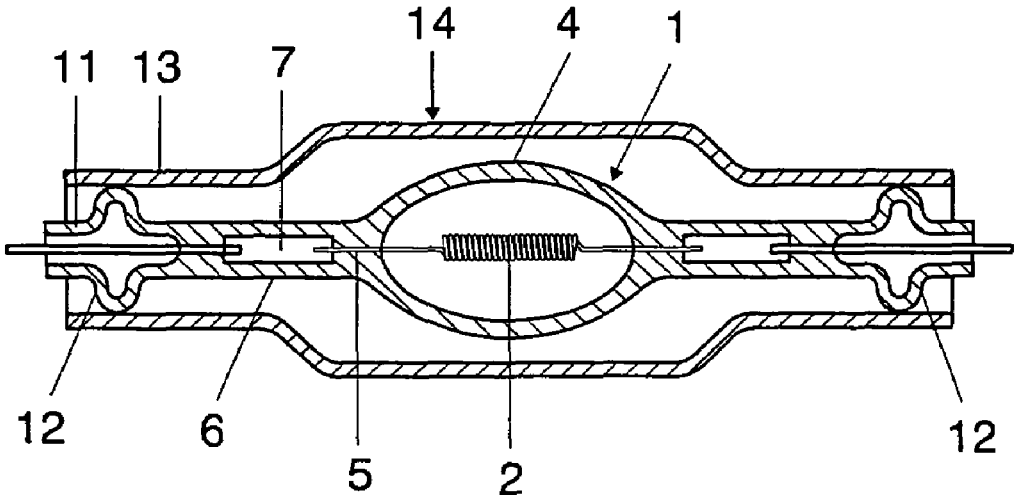
FIG. 1 shows a side view of a halogen incandescent lamp.

FIG. 1 shows the side view of a halogen incandescent lamp with a pinch seal at two ends. It comprises a cylindrical bulb 1, in whose central part 4 a luminous element 2 is axially arranged. Said luminous element is held in the bulb 1 by knobs 3.

The ends 5 of the luminous element, in their function as an internal power supply line, are embedded directly in the pinch seal 6 and are connected there to a pinch foil 7.

The pinch seal 6 has on the outside, as an extension part, which may also act as a base part, a tubular glass sleeve 11, which is integrally formed on the pinch seal and has an outer diameter of 7 mm and an inner diameter of 5 mm. The sleeve 11 is approximately 7 mm long.

A beading 12, which is essentially convex, is attached to the sleeve 11 on the outside, transversely with respect to the lamp axis. The end of an outer bulb 14, which end is in the form of a tube piece 13, is attached to said beading 12, with the result that the outer bulb extends between the two beadings 12 on both sides of the central part 4.

In addition, a base is fitted to one end of the sealing part, the base having an electrical contact element (25), which is electrically conductively connected to a power supply line (21) leading to a luminous means, the contact element being accommodated in the tubular extension (22) of the sealing part.

Figure 2:
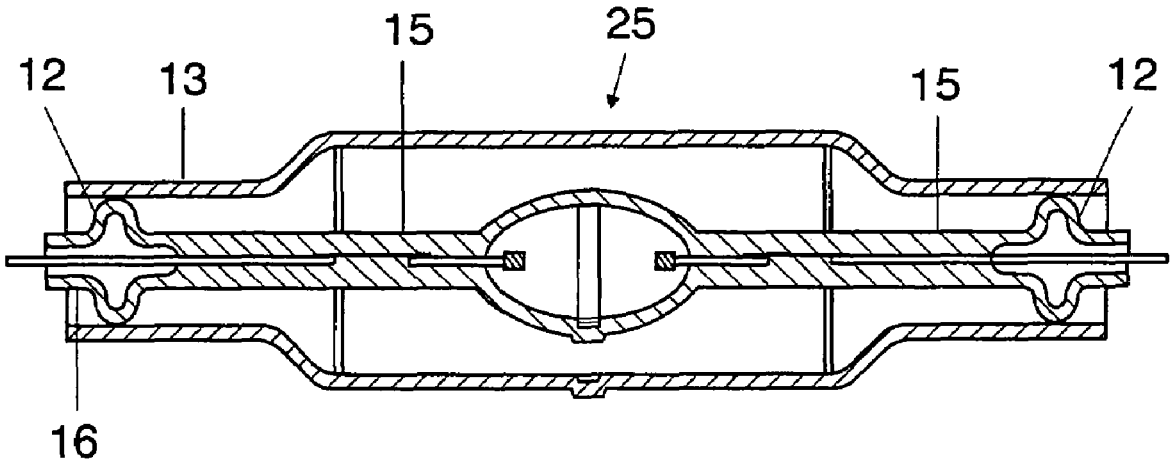
FIG. 2 shows a side view of an exemplary embodiment of a metal halide lamp.

FIG. 2 shows a metal halide lamp, which is sealed by fuse seals 15. In this case, the beadings 12, at which the tube piece 13 ends, are formed directly on the fuse seal 15. Alternatively, they can also be formed on the extension part 16, however, since in this case the least amount of material needs to be deformed.

Figure 3:
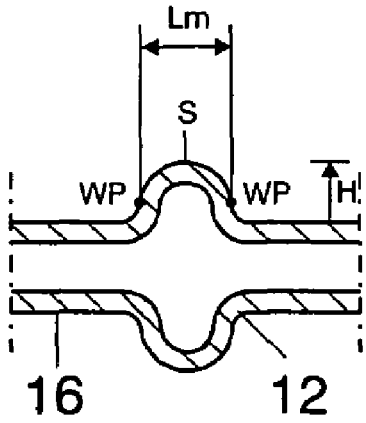
FIG. 3 shows a section of a further exemplary embodiment.
Figure 4:
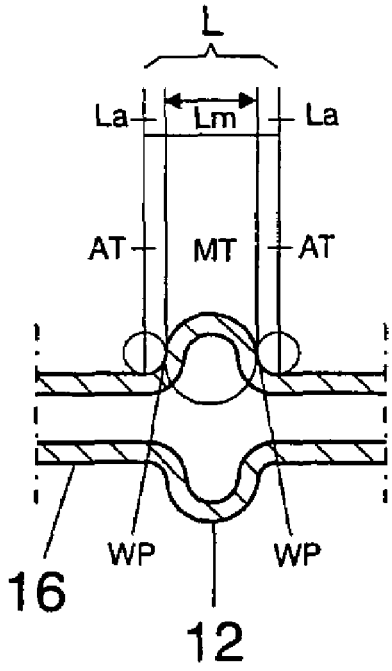
FIG. 4 shows a section of a detail of the beading.

FIG. 3 shows an example of the shape of the beading 12 in cross section. The design is essentially convex. The apex S defines the height H of the beading above the level of the support, i.e. the sealing part. The curvature is convex in the center and concave on the outside. The points of inflection are given the reference WP. This means, as shown in FIG. 4, that the beading has a convex central part MT and two concave outer parts AT, the length Lm of the central part making up at least 50% of the total length L of the beading in the axial direction. On the outside, the concave outer parts AT have a length La of in each case at most 25% of the total axial length L. The boundary between the outer parts AT and the central part MT is defined by the points of inflection WP.

Figure 5A:
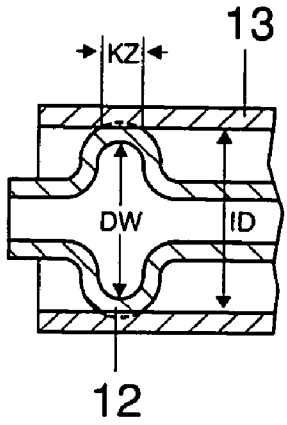
FIGS. 5 and 6 show detailed sections of further exemplary embodiments of a beading.
Figure 5B:
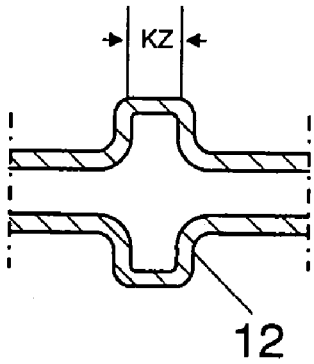

FIG. 5*a* shows a section, which shows an enlarged illustration of the beading 12. The maximum diameter DW of the beading would actually be slightly larger, preferably by 1 to 2 mm, than the inner diameter ID of the tubular end 13 of the outer bulb 14. However, it is pressed flat against the tube piece 13, with the result that the shape in FIG. 5*b* is produced. Owing to the pronounced saddle region of the beading, the axial contact zone KZ is at least 2 mm, often even from 3 to 4 mm long. FIG. 5*b* shows a beading, which is in the form of a bridge arc, and provides a particularly long contact zone KZ. In practice, it is shown that a contact zone KZ which is as large as possible in the axial direction between the beading and the outer bulb has a critical influence on the strength of the connection.

Figure 6:
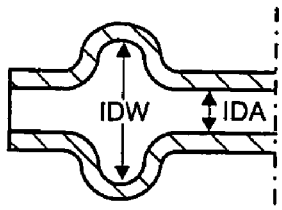

The strength of the connection is finally based in a decisive manner on the production method, which leads to a concave/convex beading always being produced, as shown in FIG. 6. A characterizing feature of such a concave/convex beading is the fact that the inner diameter IDW of the beading is larger than the inner diameter IDA of the extension part or sealing part surrounding it.

Figure 7:
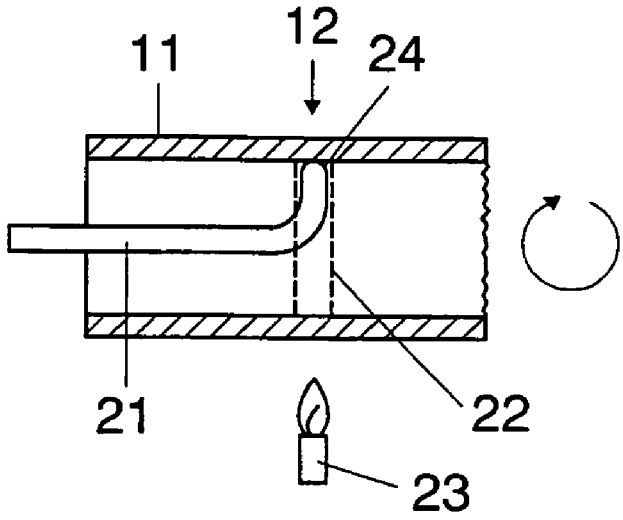
FIGS. 7 and 8 show detailed sections of exemplary embodiments for the production of a beading.

Two methods have proved successful as production methods. In a first method (FIG. 7), a mechanical finger 21 is used, which is similar to a poker and is introduced into the extension part 11 once the point 22, at which the beading 12 is to be applied, has first been preheated, as is known per se, for example using a burner 23 from the outside or from the inside. The extension part 11 in this case rotates (arrow). The end 24 of the poker is shaped such that it provides the shape of the beading. The extension part 11 in this case rotates such that the beading is rotationally symmetrical. This method allows for precise shaping of the beading. The outer bulb is at the latest at this point positioned such that a tube piece 13 lies in a suitable manner over the zone 22. The beading is produced using the poker 21, the distance from the outer bulb being dimensioned such that the apex and the contact zone of the beading achieve intimate contact with the tube piece. In this case, the tube piece is advantageously also warmed from the outside.

Figure 8:
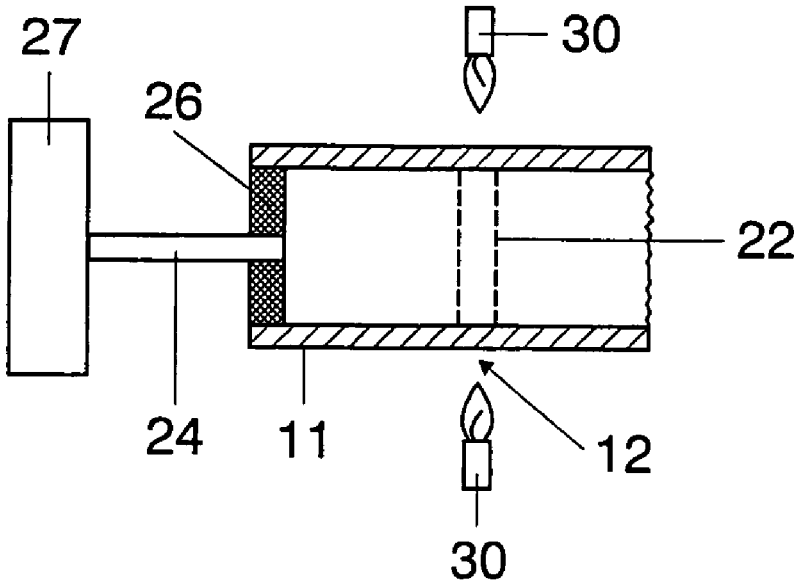

A preferred, second production method (FIG. 8) likewise initially heats the point 22, at which the beading 12 is to be applied, preferably using a ring burner. Rotation of the extension part is in this case not absolutely necessary. A suitably metered excess pressure of an inert gas (argon etc.) is then introduced into the extension part 11 via a sealed feed line 24, such that the heated annular zone 22 bulges out. At the latest at this point in time, the outer bulb is again positioned such that a tube piece 13 lies in a suitable manner over the zone 22. The beading is produced using the excess pressure, the distance from the outer bulb being dimensioned such that the apex and the contact zone of the beading achieve intimate contact with the tube piece. In this case, the tube piece is also advantageously warmed from the outside.

The seal is given the reference 26, and the reservoir for the gas is given the reference 27. The shaping takes place by selecting the axial temperature distribution at the zone in conjunction with a suitably selected excess pressure. A rapid injection of pressure has proven successful, whose maximum pressure is of the order of magnitude of from 0.8 to 7 bar, for example 5 bar. This method has the advantage of being highly suitable for industrial production, owing to the high degree of automation potential.

This production is precisely the opposite of the production of a solid beading, which is produced by compression and in which the outer bulb is matched subsequently to the ready-made beading from the outside, in which case high stresses are always produced which need to be relieved carefully by tempering.

The invention claimed is:

1. An electric lamp comprising an outer bulb having an elongate inner bulb defining a longitudinal axis (A) and which is sealed in a vacuum-tight manner at mutually opposing ends by sealing pans, the outer bulb being placed, with an attached tube piece, over the inner bulb and being fixed to a sealing pad by means of an annular beading formed on the inner bulb, wherein the beading protrudes from a wall defining the inner bulb on a side facing the outer bulb, and wherein the tube piece is attached radially to the beading, and wherein the tube piece extends axially to intersect at least the maximum diameter of the beading, the beading having three axially sequential parts, which on a corresponding side of the wall facing away from the outer bulb define a hollow cavity having an axial width greater than the wall thickness: a convex central part MT, and two concave outer parts AT, wherein there is a point of inflection between the convex central part and each concave outer part, and wherein the axial length Lm of the convex central part MT, measured from one point of inflection to the other, is at least 50% of the total length L of the beading and in which the axial length La of each concave outer part AT makes up in each case at most 25% of the total length of the beading.

2. The lamp as claimed in claim 1, characterized in that the inner diameter of the beading is at least 2 mm larger than the outer diameter of the sealing part in the region of the beading.

3. The lamp as claimed in claim 1, characterized in that the beading rests on a tubular extension of the sealing part.

4. The lamp as claimed in claim 1, characterized in that the sealing part is a fuse seal or a pinch seal.

5. The lamp as claimed in claim 1, characterized in that the end of the tube piece protrudes outwards at the end of the beading.

* * * * *